United States Patent [19]

Balinski

[11] 4,233,833

[45] Nov. 18, 1980

[54] METHOD FOR STRETCHING SHEET METAL AND STRUCTURAL MEMBERS FORMED THEREFROM

[75] Inventor: Henry A. Balinski, Hoffman Estates, Ill.

[73] Assignee: United States Gypsum Company, Chicago, Ill.

[21] Appl. No.: 912,619

[22] Filed: Jun. 5, 1978

[51] Int. Cl.[3] ..... B21D 13/04; B21D 13/02; B21D 47/02

[52] U.S. Cl. ..... 72/180; 72/385; 72/377

[58] Field of Search ..... 72/180, 181, 176, 177, 72/DIG. 19, 187, 385, 377; 29/155 R, 155 C, 6.1; 113/116 A

[56] References Cited

U.S. PATENT DOCUMENTS

| | | | |
|---|---|---|---|
| 901,963 | 10/1908 | Hardie | 72/379 |
| 1,058,590 | 4/1913 | Hunker | 72/368 |
| 1,343,647 | 6/1920 | Smith | 72/379 |
| 1,623,273 | 4/1927 | Rendleman | 72/180 X |
| 1,715,330 | 5/1929 | Rendleman | 72/180 X |
| 1,771,028 | 12/1928 | Bronson et al. | 72/379 |
| 1,814,593 | 7/1931 | Gersman | 72/385 X |
| 2,183,969 | 12/1939 | McKinney | 72/180 X |
| 2,251,967 | 8/1941 | Yoder | 72/180 X |
| 3,491,573 | 1/1970 | Tennison, Sr. | 72/348 |
| 4,087,226 | 5/1978 | Mercer | 425/397 |

*Primary Examiner*—Milton S. Mehr

*Attorney, Agent, or Firm*—Samuel Kurlandsky; Robert H. Robinson; Kenneth E. Roberts

[57] ABSTRACT

Sheet metal is processed by providing one or more corrugations longitudinally along the sheet in a position spaced from both lateral edges of the sheet while the lateral edges are maintained in fixed relationship to each other, thereby causing the sheet metal portion containing the corrugations to be stretched. The corrugated portion is subsequently rolled or otherwise pressed to flatten out the corrugations either partially or completely, resulting in a sheet which is wider than the original, but which still has certain areas having the original thickness. The sheet metal thus processed may be utilized to form structural members such as channels or studs which are less expensive for a given size than conventional structural members, but which still exhibit sufficient supportive strength by virtue of the portions thereof which retain their original thickness.

2 Claims, 20 Drawing Figures

METHOD FOR STRETCHING SHEET METAL AND STRUCTURAL MEMBERS FORMED THEREFROM

FIELD OF THE INVENTION

The present invention relates to structural members formed from sheet metal, and more particularly refers to a method for forming such structural members which are less expensive to produce and which, in spite of their reduced cost by virtue of containing less material in certain areas, still provide sufficient structural support for the intended uses.

DESCRIPTION OF THE PRIOR ART

Structural members formed of sheet metal have long been used in building construction and in many other fields. In the construction field such structural members take the form of U-shaped channels, supporting studs, and furring members and channels. Such structural members are commonly fabricated by rolling long strips of sheet metal, and subsequently cutting the structures to the proper size. Such structural members are strong and provide excellent support for walls, ceilings, etc. However, because material costs of sheet metal such as steel and aluminum have increased greatly, it would be desirable to have structural members available which use less material than those presently available, and which yet offer sufficient supportive strength for use as studs to support walls, ceilings and related structures. A common method for reducing the material cost of structural members such as studs has been to roll the members from a sheet metal material having an overall reduced thickness. However, overall reduced thickness is always accompanied by reduced supportive strength and the danger of failure due to twisting or bending.

SUMMARY OF THE INVENTION

It is therefore an object of the present invention to provide a novel method for producing structural members having lower material requirements than similar structural members produced in the prior art.

It is a further object to provide a method for fabricating structural members of the type described which have excellent supportive strength.

It is a further object to provide a method of the type described which lends itself readily to mass production.

It is an additional object to provide a method of the type described which can be carried out at relatively low cost.

It is still an additional object to provide structural members having certain limited longitudinally arranged areas of thinner cross-section and other areas used for supportive purposes of thicker cross-section.

These and other objects, advantages and functions will be apparent upon reference to the specification and to the attached drawings illustrating the preferred embodiments of the invention, in which like parts are identified by like reference symbols in each of the views.

According to the invention a sheet metal strip is rolled to provide one or more longitudinal corrugations while the lateral edges of the strip are maintained in fixed relationship to each other, thereby causing the sheet metal at the corrugated areas to be stretched. The corrugated portions are subsequently pressed as by rolls to reduce the corrugations partly or completely. As a result a structure is formed which is substantially wider than the original sheet metal strip. The strip has a central portion which is of smaller cross-section than the outer portions which have not been corrugated and which retain the thickness of the original sheet. Various structural members such as channels, studs and furring members or channels can then be fabricated from the processed sheet metal strip to form structures wherein a portion such as the main web has a reduced cross-sectional surface while the flanges at the end thereof retain theie original thickness for providing support, while at the same time the material costs of the structural member has been substantially reduced.

DESCRIPTION OF THE PREFERRED EMBODIMENTS

Figure 1:
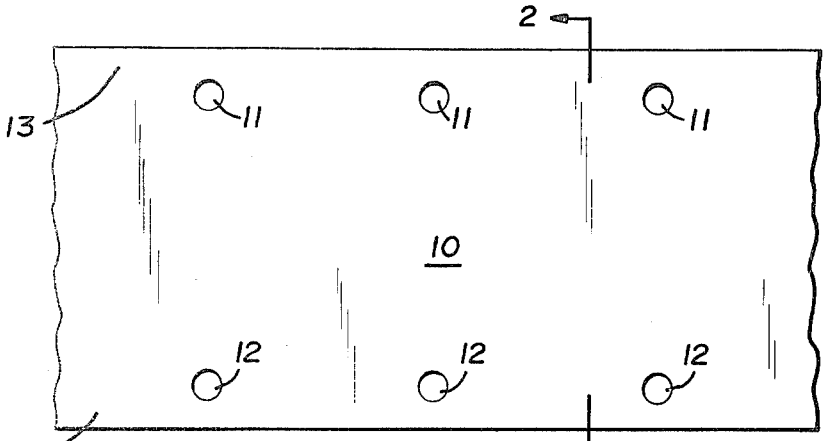
FIG. 1 is a plan view of a portion of a sheet metal strip.
Figure 2:
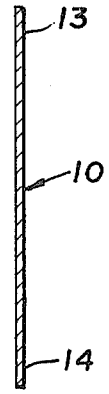
FIG. 2 is a cross-sectional view taken at the line 2—2 of FIG. 1, looking in the direction of the arrows.
Figure 3:
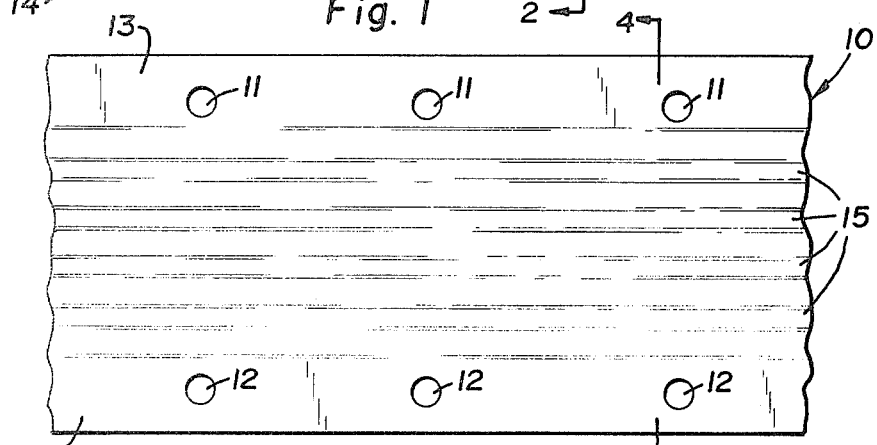
FIG. 3 is a plan view of the strip shown in FIG. 1 after it has passed through corrugating rolls.
Figure 4:
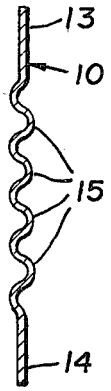
FIG. 4 is a cross-sectional view taken at the line 4—4 of FIG. 3, looking in the direction of the arrows.
Figure 5:
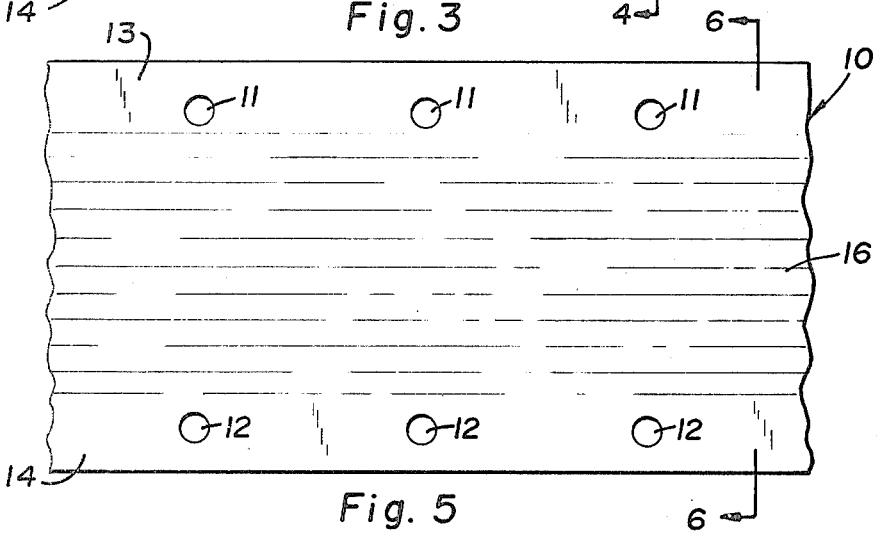
FIG. 5 is a plan view of the strip portion shown in FIGS. 3 and 4 after the strip has been passed through compression rolls to reduce or remove the corrugations.
Figure 6:
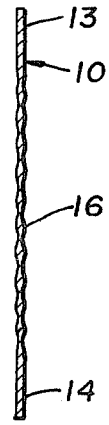
FIG. 6 is a cross-sectional view taken at the line 6—6 of FIG. 5, looking in the direction of the arrows.

Referring to FIGS. 1–6, sheet metal strips are shown in various stages of the method of the present invention. In FIGS. 1 and 2 a flat sheet metal strip 10 is shown in the state in which it is obtained and prior to processing. The strip in one embodiment may be provided with a plurality of holes 11 and 12 through which some fastening means such as bolts or lugs may be received in order to maintain the edges or borders of the strip in fixed relationship to each other during processing. In the second step corrugating means such as a mold or complementary corrugating rolls are applied to the central portion of the strip in a longitudinal direction to form the strip shown in FIGS. 3 and 4 having corrugations 15 longitudinally in a central portion of the strip. Because the edges or the borders 13 and 14 of the strip are clamped by means of bolts or lugs to maintain them in fixed relationship to each other, the corrugation step accomplishes a stretching of the metal forming the corrugations. Consequently, the metal in the corrugations is now thinner than the metal of the non-corrugated area, the uncorrugated areas retaining their original thickness. Following the corrugation step, a flattening mold or complementary flattening rolls are applied to the corrugated area to flatten the corrugations until the corrugations are partially or completely removed and a substantially flat sheet is formed as shown in FIGS. 5 and 6. The central area 16, is now thinner than the margins 13 and 14. The sheet as shown in FIGS. 5 and 6 is now substantially wider than the strips of FIGS. 1–4, since the portion which was previously corrugated and subsequently rolled to remove the corrugations was stretched by the process and the previously corrugated area 16 now has a thinner cross-section than the margins 13 and 14.

Figure 7:
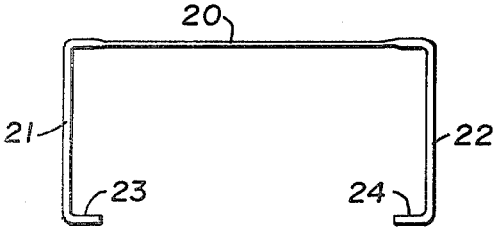
FIG. 7 is a cross-sectional view of a stud formed from the corrugated and stretched strip shown in FIGS. 5 and 6.

FIG. 7 shows an end view of a stud which was formed from a stretched sheet such as than shown in FIGS. 5 and 6. The stud comprises a web 20 which is formed of the area which was stretched by corrugating and subsequent flattening. The stud additionally comprises flanges 21 and 22 and hems 23 and 24. Because of the stretching and concommitant reduction in the thickness of the metal of the web 20, the stud is substantially lighter than studs prepared from unstretched sheet metal having the thickness of the webs 21 and 22. The material cost is therefore materially reduced, and the added cost of the additional processing is much lower than the material savings accomplished. Moreover, because the flanges 21 and 22 and hems 23 and 24 retain their original thickness, they are able to provide the necessary longitudinal supportive strength necessary in the overall construction and are sufficiently rigid to prevent twisting or bending of the stud under any loads they might be called upon to support.

Figure 8:
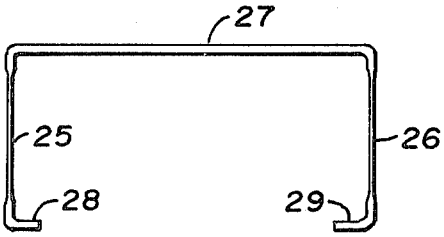
FIG. 8 is a cross-sectional view showing a stud prepared by the method of the invention in another embodiment thereof.

FIG. 8 shows a modified embodiment in which the metal of the flanges is corrugated and subsequently flattened to reduce the thickness. However, the web 27 and the hems 28 and 29 retain their original thickness and provide adequate structural support. Because of the reduction in thickness of the flanges 25 and 26, the stud weighs less than studs formed of sheet metal of the original thickness and which has not been subjected to reduction.

Figure 9:
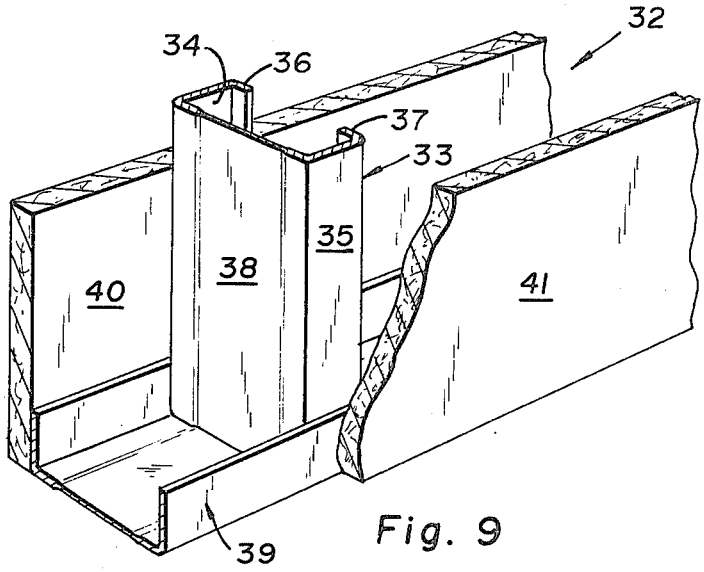
FIG. 9 is a perspective view showing a construction of a wall utilizing a stud such as shown in FIG. 7.

Referring to FIG. 9, a wall is shown having a wall structure 32 supported by a stud 33 according to the invention and similar to that shown in FIG. 7. The stud comprises a pair of flanges 34 and 35 and hems 36 and 37. The flanges are connected by a web 38 which has been corrugated and flattened to reduce the thickness of the metal thereof, according to the invention. The flanges and hems have retained their original thickness and provide the necessary longitudinal support, while the stud itself is lighter and less expensive to produce because of the material savings. The lower end of the stud 33 is mounted in a U-channel 39 and a pair of wallboards 40 and 41 are affixed to the stud 33.

Figure 10:
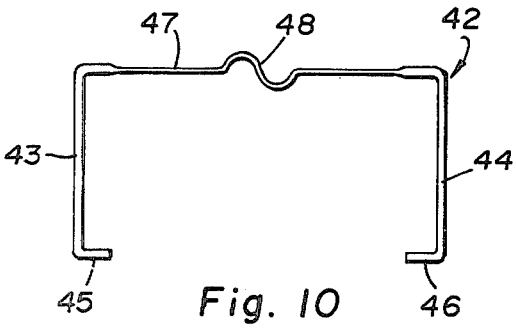
FIG. 10 is a cross-sectional view of a stud formed by the invention in an alternative embodiment.

FIG. 10 illustrates a stud similar to that shown in FIG. 7. The stud 42 comprises flanges 43 and 44 and hems 45 and 46. A web 47 is formed of a portion of the metal which was stretched according to the method of the invention as described above. However, instead of completely removing all corrugations, a pair of corrugations 48 were left and serve to increase the longitudinal rigidity and provide additional support.

Figure 11:
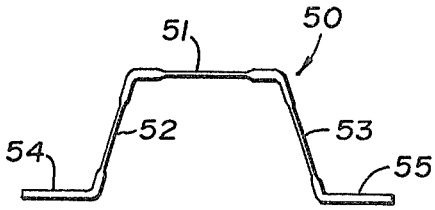
FIG. 11 is a cross-sectional view taken of a furring channel produced by the method of the present invention.

FIG. 11 illustrates a furring channel 50 comprising a web 51 flanges 52 and 53, and hems 54 and 55. The web 51 and flanges 52 and 53 are largely formed of stretched portions of the original sheet, while the hems 54 and 55 are formed of portions which retain their original thickness.

Figure 12:
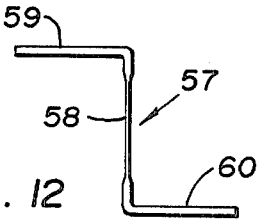
FIG. 12 is an end view of a Z-type furring channel.

FIG. 12 shows a Z-shaped furring channel 57 comprised of a web 58 and flanges 59 and 60. In this structure the web is formed of a stretched portion of the sheet and has a thinner cross-sectional dimension, while the flanges 59 and 60 are formed of portions of the original sheet which retain their original cross-sectional dimensions, thereby providing supportive strength.

As described above, according to the invention a sheet metal strip is corrugated by rolling or pressing while the edges or margins of the sheet are maintained in fixed relationship to each other. There are a number of ways in which this may be done, and the apparatus and procedures for accomplishing the process are disclosed in FIGS. 13–20.

Figure 13:
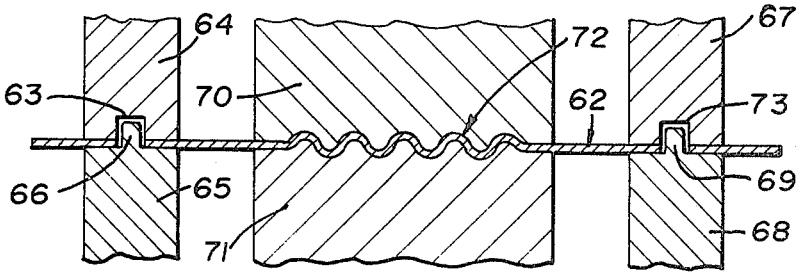
FIG. 13 is an elevational schematic view showing means for carrying out the method of the present invention in one embodiment.

FIG. 13 illustrates an arrangement wherein the sheet metal strip 62 is provided with apertures 63 along both margins. The sheet is maintained in place by clamping members 64 and 65, one member having a lug 66 passing through the aperture 63 and received in a complementary recess in the other clamping member. On the other side of the sheet clamping members 67 and 68 grip the sheet and clamping member 68 has a lug 69 which passes through the aperture 63 of the sheet 62 and is received in a complementary recess 73. Complementary dies or rolls 70 and 71 have corrugating surfaces which provide corrugations 72 in the sheet 62. Since the clamping members retain the margins of the sheet 62 in fixed relationship to each other during the corrugation process, the process necessarily results in stretching of the sheet metal in order to form the corrugations. The corrugated portion 72 is subsequently rolled or pressed to reduce the corrugated portion to substantially a flat member, thereby causing the width of the sheet metal strip 62 to increase.

Figure 14:
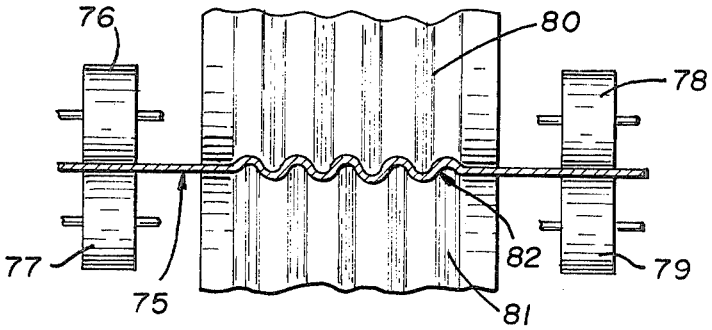
FIG. 14 is a schematic cross-sectional view showing means for carrying out the method for the present invention in another embodiment.

FIG. 14 illustrates another apparatus arranged to retain the margins of the sheet in fixed relationship to each other while the central portion is stretched by applying corrugations. In this embodiment the sheet 75 has its margins retained in fixed relationship to each other by clamping rolls 76, 77, 78, and 79. Corrugating rolls 80 and 81 apply corrugations 82 to the sheet 75 while the margins of the sheet are maintained in fixed relational position, thereby causing the corrugated portion 82 to be stretched. The corrugation is subsequently rolled flat to expand the width of the sheet.

Figure 15:
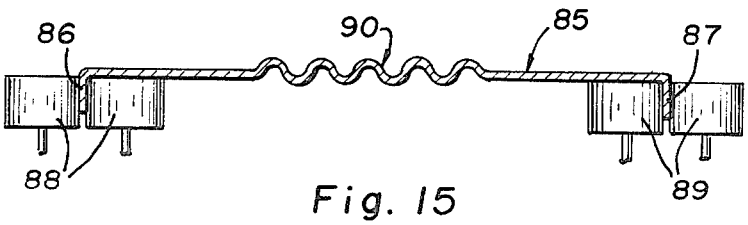
FIG. 15 is a schematic end view showing still another way of carrying out the method of the present invention.
Figure 16:
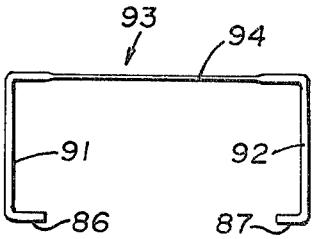
FIG. 16 is an end view of a stud formed from the method shown in FIG. 16.

FIGS. 15 and 16 show still another method for maintaining the margins of the sheet in fixed relationship while applying the central corrugations. As shown in FIG. 15, the sheet 85 is first provided with hems 86 and 87, rotatable retaining rolls 88 and 89 engage the hems 86 and 87, respectively, and maintain the margins in fixed relationship while corrugations 90 are applied to the central portion of the sheet 86. The corrugated area is then rolled to remove the corrugations, thereby increasing the width of the sheet. The sheet is then further formed by conventional methods to provide flanges 91 and 92, thereby forming a stud 93 having a web 94 which is thinner than the remainder of the stud.

Figure 17:
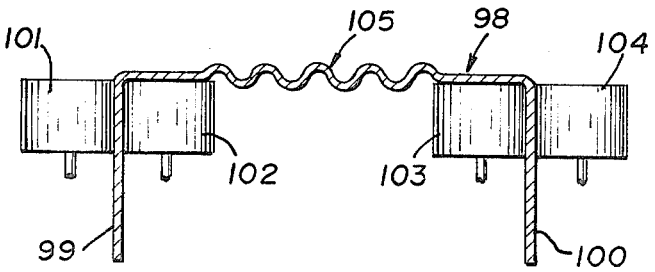
FIG. 17 is a schematic elevational view showing a further method of carrying out a further embodiment of the method of the present invention.
Figure 18:
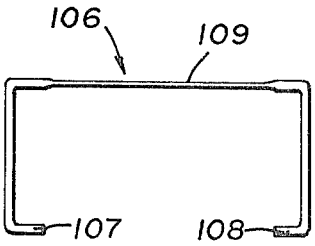
FIG. 18 is an end view of a stud formed by the method shown in FIG. 17.

Referring to FIGS. 17 and 18, still another apparatus arrangement is shown in which the sheet 98 is first formed to provide flanges 99 and 100. The partially formed sheet is then placed within retaining rolls 101 and 102, and 103 and 104, for retaining the margins of the structure in fixed relationship, while corrugations 105 are applied by rolling as previously described. The corrugated portion is subsequently rolled to reduce the corrugations either partially or completely, thereby extending the width of the structure. A completed stud 106 is then formed by additionally providing hems 107 and 108. The web 109 is now of reduced thickness.

Figure 19:
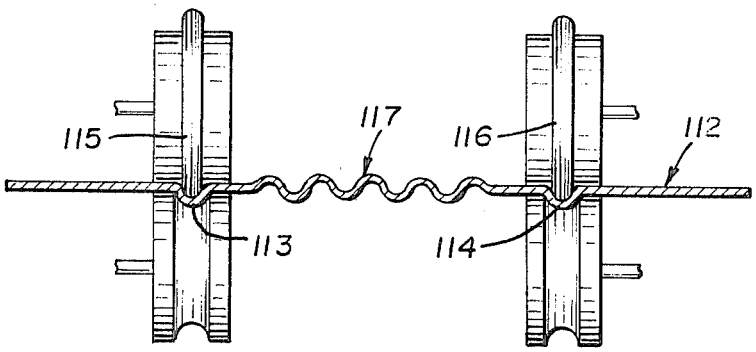
FIG. 19 is a schematic end view of still an additional method of carrying out still another embodiment of a method of carrying out the present invention.
Figure 20:
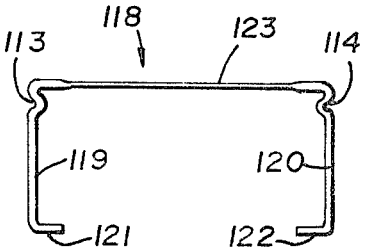
FIG. 20 is an end view of a stud formed by the method shown in FIG. 19.

Referring to FIGS. 19 and 20, a further modified apparatus is shown for carrying out the method of the invention. In FIG. 19 a sheet metal strip 112 is first provided with longitudinal grooves 113 and 114 of arcuate cross-section. During the stretching operation, a pair of retaining wheels 115 and 116 ride in the grooves 113 and 114, respectively, thereby maintaining the margins of the sheet in fixed relationship. Corrugations 117 are formed in a central portion of the sheet by complementary rolls, as described above, thereby accomplishing a stretching of the metal in the corrugation area. Subsequently the corrugations are either partly or completely rolled out to provide an increase in the width of the sheet. A stud 118 shown in FIG. 20 is then formed by conventional means comprising flanges 119 and 120, and hems 121 and 122. The web 123 is of reduced thickness to conserve materials and reduce weight, while the remainder of the structure has its original thickness to provide adequate supportive strength. The grooves 113 and 114 remain to provide increased strength and rigidity.

The method of the present invention and the products produced thereby have a number of advantages over methods and products known in the prior art. First, the method provides a very convenient way of producing an integral sheet metal structure wherein a portion but not all of the width thereof is of reduced thickness, thereby accomplishing a savings in material and reduction in weight. The process may be carried out by readily available machinery and thickness reduction may be very precisely applied in limited areas of the sheet metal strip. The limited areas may be so chosen that, although a reduction in material costs and weight are obtained, other portions of the structure may be left at their original thickness where necessary to provide sufficient supportive strength. The method may be applied to various types of structural members such as channels, studs, furring members, cable support trays, and many other metal structures formed of sheet metal and known in the art.

It is to be understood that the invention is not to be limited to the exact details of composition, materials, or method of operation shown or described, as obvious modifications and equivalents will be apparent to one skilled in the art.

I claim:

1. A method for forming a stud from a metal sheet in strip form while increasing the width of the sheet, which comprises providing a hem at each margin of the sheet substantially perpendicular to said sheet, said hem being of substantial width maintaining said hems in fixed relationship to each other by means of backup rolls and at the same time providing corrugations solely in a limited central area with respect to the width of said sheet while margins at the two edges of said sheet parallel to said corrugations are maintained flat, unstretched and in substantially fixed relationship to each other, thereby causing the metal at said corrugations to be stretched, at least partially reducing the depth of the corrugations by rolling to increase the width of said sheet, and forming said sheet to provide flanges, thereby forming a stud having certain limited areas of reduced thickness and the remainder of said stud of original thickness.

2. A method for forming a stud from a metal sheet in strip form while increasing the width of said sheet, which comprises forming a pair of substantially parallel flanges substantially perpendicular to a web of said sheet, forming a plurality of corrugations solely in a limited central area of said web with respect to the width of said sheet while margins at the two edges of said web parallel to said corrugations are maintained flat, unstretched, and in substantially fixed relationship to each other, by rolling while said flanges are maintained in substantially fixed relationship to each other by means of backup rolls, thereby causing the metal at the corrugations to be stretched, at least partially reducing the depth of the corrugations to increase the width of the web, and subsequently forming hems at the edges of said flanges to provide a stud having a web having limited areas of reduced thickness with respect to the remainder of the structure.

* * * * *